US007781986B2

(12) United States Patent
Liang et al.

(10) Patent No.: US 7,781,986 B2
(45) Date of Patent: Aug. 24, 2010

(54) INVERTER WITH ADJUSTABLE RESONANCE GAIN

(75) Inventors: Shih An Liang, Taoyuan Hsien (TW); Kuo-Hei Lee, Taoyuan Hsien (TW); Ken-Chuan Hsu, Taoyuan Hsien (TW)

(73) Assignee: FSP Technology Inc., Taoyuan Hsien (TW)

( * ) Notice: Subject to any disclaimer, the term of this patent is extended or adjusted under 35 U.S.C. 154(b) by 226 days.

(21) Appl. No.: 12/024,904

(22) Filed: Feb. 1, 2008

(65) Prior Publication Data

US 2009/0195172 A1 Aug. 6, 2009

(51) Int. Cl.
*H05B 37/02* (2006.01)

(52) U.S. Cl. ..... 315/307; 315/224; 315/276

(58) Field of Classification Search ..... 315/209 R, 315/224, 247, 276, 291, 307–308
See application file for complete search history.

(56) References Cited

U.S. PATENT DOCUMENTS 5,977,725 A * 11/1999 Miyazaki et al. ..... 315/291
7,411,360 B2 * 8/2008 Henry ..... 315/307
2004/0228153 A1 * 11/2004 Cao et al. ..... 363/71
2007/0052373 A1 * 3/2007 Hui et al. ..... 315/291
2007/0114952 A1 * 5/2007 Yang ..... 315/307
2008/0246413 A1 * 10/2008 Lin ..... 315/276

FOREIGN PATENT DOCUMENTS

TW 1290707 B 12/2007

* cited by examiner

*Primary Examiner*—Douglas W Owens
*Assistant Examiner*—Tung X Le
(74) *Attorney, Agent, or Firm*—Muncy, Geissler, Olds & Lowe, PLLC

(57) ABSTRACT

The present invention includes a PWM unit, a switch unit, a resonance unit, a transformer, a feedback unit and a frequency control unit, wherein the switch unit obtains a DC power from a power source, the PWM unit produces a working cycle signal to drive the switch unit to convert the DC power into a pulse power and the resonance unit converts the pulse power into a driving power for providing to the transformer to convert thereof into an output power, characterized in that when the resonance unit is under a starting frequency and a working frequency higher than the starting voltage, a starting voltage gain and a working voltage gain respectively corresponding thereto are produced, wherein the starting voltage gain is larger than the working voltage gain, so that the larger starting voltage gain can produce the output power with higher voltage to smoothly initiate the lamp tube set.

4 Claims, 4 Drawing Sheets

| Item | Pin(W) | $R_{lamp(K\Omega)}$ | Fs(KHz) | $V_{lamp(V)}$ simulate |
|---|---|---|---|---|
| 1 | 21.6 | 32.45 | 67.57 | 1210 |
| 2 | 46 | 22.35 | 62.5 | 1370 |
| 3 | 62.5 | 19.07 | 60.98 | 1470 |
| 4 | 78 | 16.77 | 58.82 | 1570 |
| 5 | 91 | 15.6 | 57.14 | 1700 |
| 6 | 108 | 14.84 | 55.86 | 1840 |

INVERTER WITH ADJUSTABLE RESONANCE GAIN

FIELD OF THE INVENTION

The present invention is related to an inverter with adjustable resonance gain, and more particularly to an inverter applied to drive lamp tube which utilizes resonance change to adjust driving voltage.

BACKGROUND OF THE INVENTION

The main elements for LCD (Liquid Crystal Display) are polarizer and backlight module. The backlight module produces uniform light, and then, the light is polarized by polarizers with different colors so as to generate multi-color picture. For generating uniform light, the backlight module has to equip with multiple long life lamp tubes and an inverter for providing power thereto, wherein the brightness of the lamp tube can be altered through adjusting the magnitude of the output power from the inverter. The conventional inverter, as shown in FIG. 1, includes a power source 1, a dimming signal source 6, a PWM (Pulse Width Modulation) unit 3, a switch unit 2, a resonance unit 4, a transformer 5 and a feedback unit 7. The power source 1 provides DC power, the PWM unit 3 produces a working cycle signal to drive the switch unit 2, and the DC power is switched by the switch unit 2 to form a pulse power. The resonance unit 4 obtains the pulse power and converts thereof into a driving power through resonance, and then, the transformer 5 converts the driving power into an output power to drive a lamp tube set 9. The dimming signal source 6 produces a dimming signal to the PWM unit 3 for adjusting the duty cycle of the working cycle signal so as to control the magnitude of the output power. The feedback unit 7 draws a feedback signal from the secondary side of the transformer 5 and transmits the feedback signal to the PWM unit 3 for achieving feedback regulation. In the conventional inverter, the duty cycle of the working cycle signal is utilized to control the magnitude of the output power. Mostly, the resonance circuit used to drive the inverter of the backlight module is an LC resonance circuit. The equivalent circuit of basic LC resonance circuit is shown in FIG. 2A, wherein $R_{lamp}$ represents equivalent resistor of a lamp tube, $V_d(t)$ represents input voltage, Ls represents resonance inductor, Cp represents resonance capacitor and the input voltage is a pulse power of constant voltage, and $V_\lambda$ represents potential difference of lamp. The input voltage and the output voltage are calculated as followed:

$$\frac{v_\lambda(j\omega)}{v_d(j\omega)} = \frac{R_{lamp} // \frac{1}{j\omega C_p}}{j\omega L_s + \left(R_{lamp} // \frac{1}{j\omega C_p}\right)} \tag{1-1}$$

After transposition, it obtains $$\frac{v_\lambda(j\omega)}{v_d(j\omega)} = \frac{\frac{R_{lamp}}{1 + j\omega C_p}}{j\omega L_s + \frac{R_{lamp}}{1 + j\omega C_p}} = \frac{R_{lamp}}{(j\omega L_s R_{lamp})(j\omega C_p) + j\omega L_s + R_{lamp}} \tag{1-2}$$

For simplifying the formula described above, it further defines that:

$$Q = \frac{R_{lamp}}{\sqrt{\frac{L_s}{C_p}}} \tag{1-3}$$

wherein Q is defined as serial resonance quality factor, and $$Z_o = \omega_o L_s = \frac{1}{\omega_o C_p} = \sqrt{\frac{L_s}{C_p}} \tag{1-4}$$

wherein $Z_O$ is the property impedance of the resonance circuit.

Through formulas (1-3) and (1-4), formula (1-2) can be simplified as followed:

$$\frac{v_\lambda(j\omega)}{v_d(j\omega)} = \frac{1}{1 - \left(\frac{\omega}{\omega_o}\right)^2 + j\frac{1}{Q}\left(\frac{\omega}{\omega_o}\right)} \tag{1-5}$$

Please refer to FIG. 2B, which shows the gain curve of transfer function of LC resonance circuit. The conventional LC resonance circuit is operated under fixed frequency so as to form fixed voltage gain. Through the PWM unit 3, the duty cycle of the working cycle signal can be altered for adjusting the brightness of the lamp tube set 9, as disclosed in R.O.C. Patent No. 1290707, entitled "Parallel driving circuit of multiple lamps in LCD and a uniformity control method thereof". In FIG. 3 of this patent, a resonance inductor (Lr) and a resonance capacitor (Cr) are disposed at the primary side of transformer T1. Through the sine wave produced by the resonance inductor (Lr) and the resonance capacitor (Cr), the transformer T1 can convert the power. However, the inverter described above which controls the brightness through altering the working cycle signal is disadvantageous that:

1. The adjustment of the duty cycle of the working cycle signal will cause the switch unit of the inverter to have an unstable zero voltage switching, so as to cause extra loss.
2. The adjusting range of the duty cycle is limited since the elements of the switch unit have limited voltage withstand.

Therefore, there is the need to improve the inverter used for driving backlight module.

SUMMARY OF THE INVENTION

Consequently, the object of the present invention is to provide an inverter with improved resonance, thereby enlarging the range of dimming and zero voltage switching.

The present invention is to provide an inverter with adjustable resonance gain including a PWM unit, a switch unit, a resonance unit, a transformer, a feedback unit and a frequency control unit, wherein the switch unit obtains a DC power from a power source, the PWM unit produces a working cycle signal to drive the switch unit to convert the DC power into a pulse power and the resonance unit converts the pulse power into a driving power for providing to the transformer to convert thereof into an output power, so as to drive a lamp tube set linked to the inverter, characterized in that when the resonance unit is under a starting frequency and a working frequency higher than the starting voltage, a starting voltage gain and a working voltage gain respectively corresponding thereto are produced, wherein the starting voltage gain is larger than the working voltage gain, so that the larger starting voltage gain can produce the output power with higher voltage so as to smoothly initiate the lamp tube set, and thus, through controlling the frequency of the pulse power, the voltage gain of the resonance unit can be altered.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
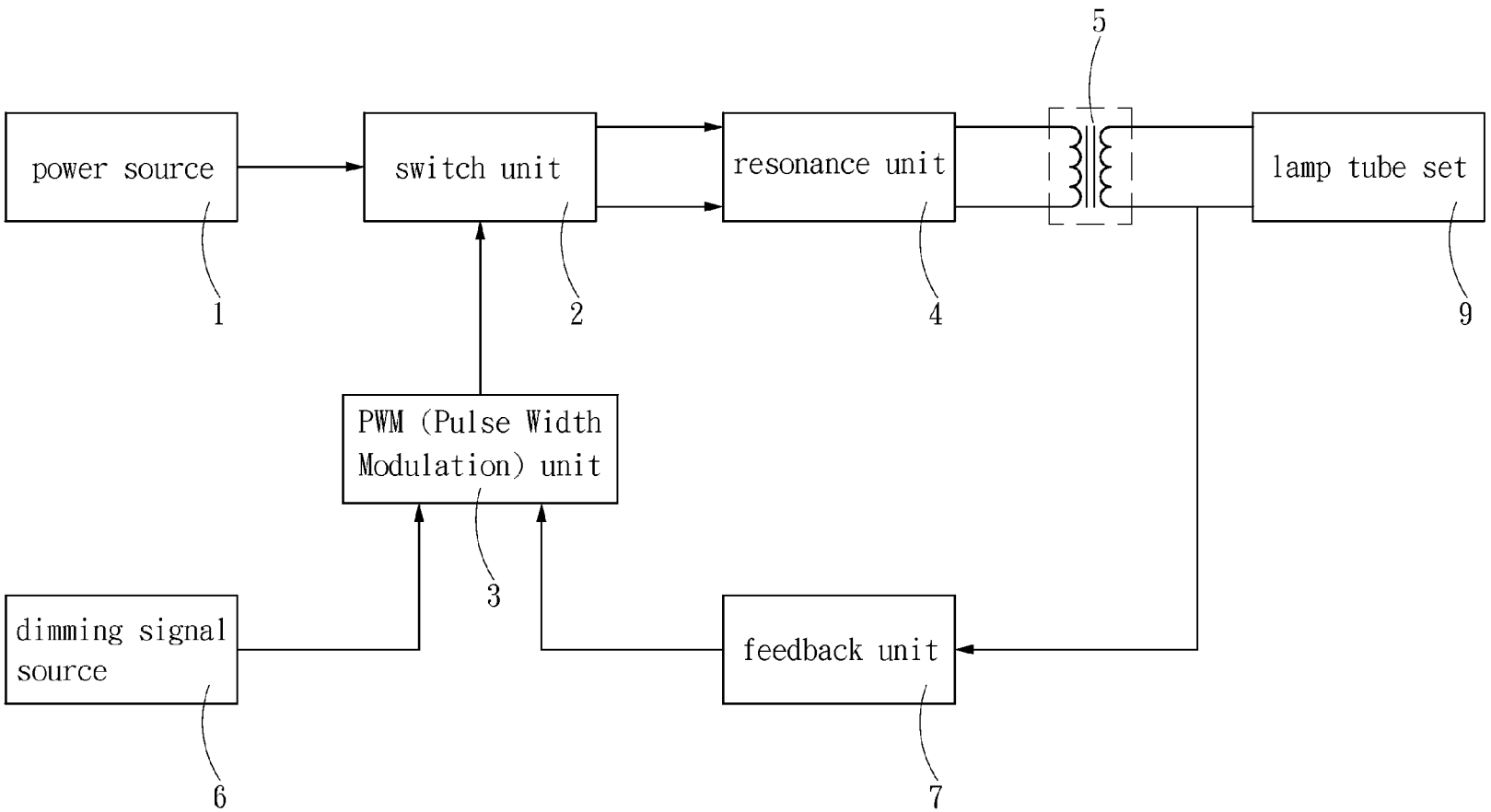
Fig. 1 PRIOR ART
FIG. 1 shows the architecture of the conventional inverter used for driving the lamp tube.
Figure 2A:
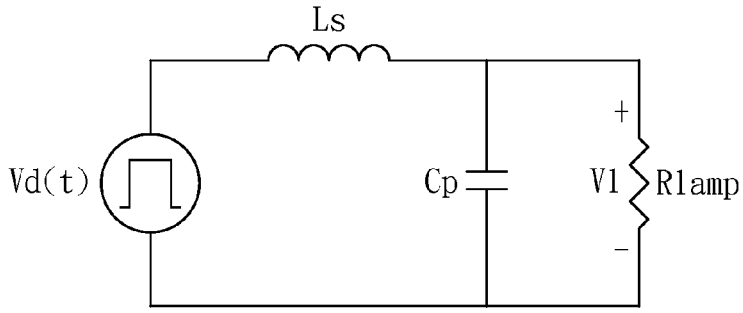
Fig. 2A PRIOR ART
FIG. 2A shows the architecture of the conventional resonance unit used in the inverter of FIG. 1.
Figure 2B:
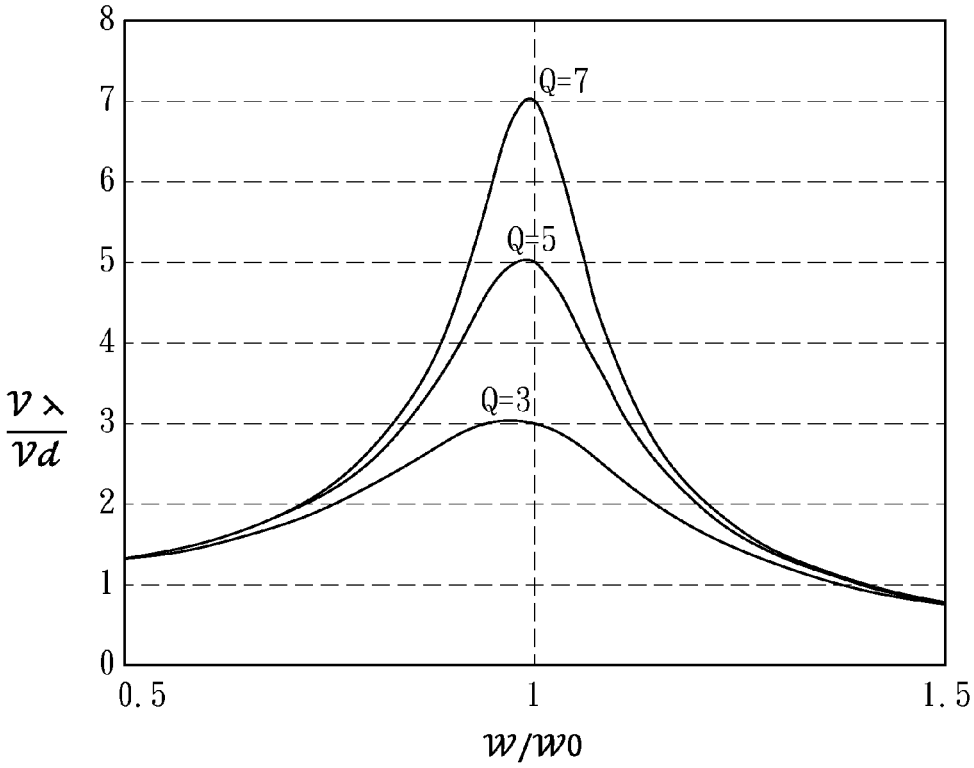
Fig. 2B PRIOR ART
FIG. 2B shows a gain curve of transfer function of FIG. 2A.
Figure 3:
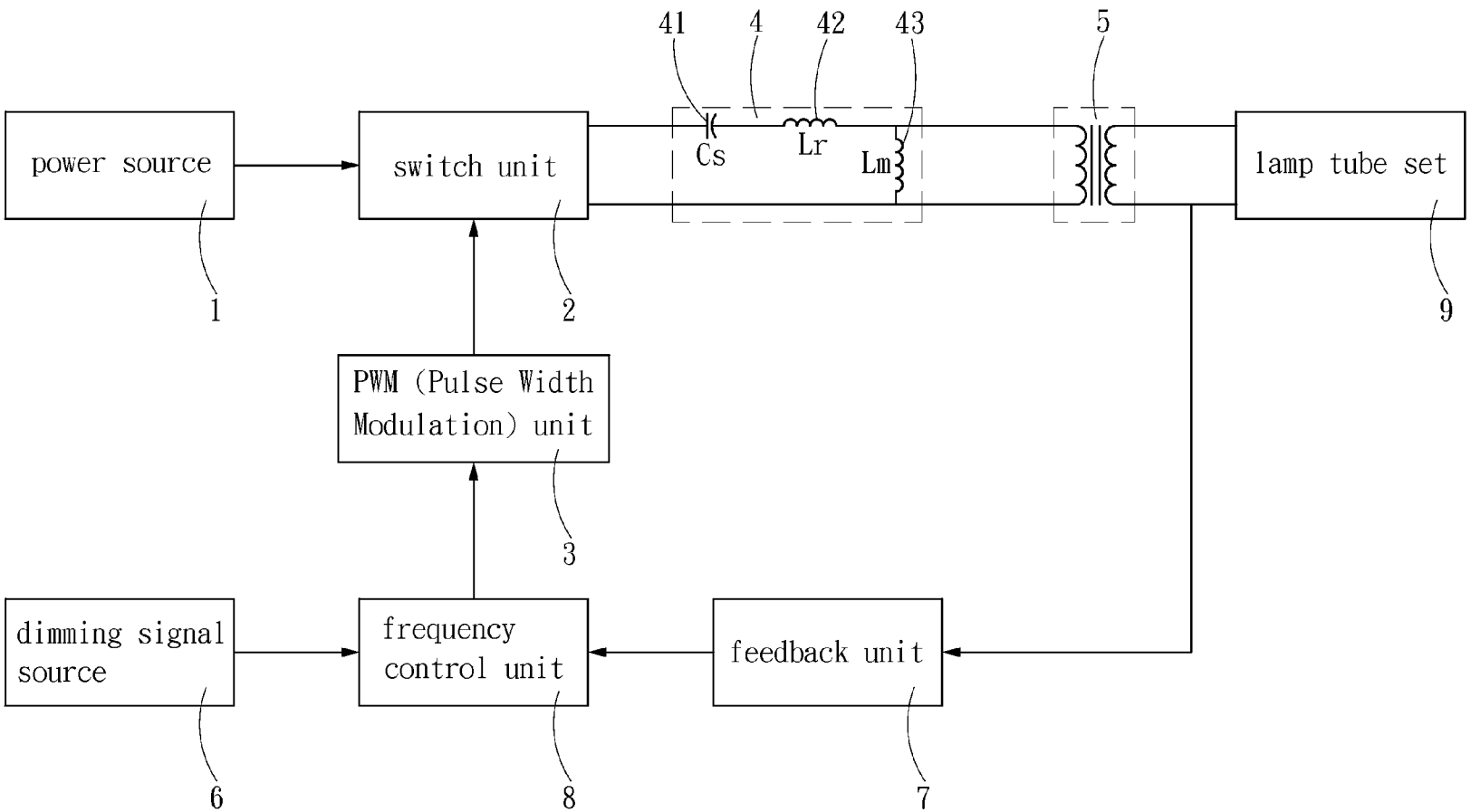
FIG. 3 shows the circuit architecture of the present invention.

Please refer to FIG. 3, which is a schematic view showing an inverter with adjustable resonance gain. The inverter includes a PWM (Pulse Width Modulation) unit 3, a switch unit 2, a resonance unit 4, a transformer 5, a feedback unit 7 and a frequency control unit 8. The PWM unit 3 produces a working cycle signal to drive the switch unit 2, and through the driving by the working cycle signal, a DC power obtained from a power, source 1 by the switch unit 2 is converted into a pulse power for outputting to the resonance unit 4. The resonance unit 4 converts the pulse power into a driving power, and then, the transformer 5 converts the driving power into an output power for driving a lamp tube set 9. Moreover, the frequency control unit 8 is connected to a dimming signal source 6 and the feedback unit 7, wherein the feedback unit 7 draws a feedback signal from the secondary side of the transformer 5, and the dimming signal source 6 provides a dimming signal. Then, the frequency control unit 8, in accordance with the dimming signal and the feedback signal, produces a reference frequency signal for providing to the PWM unit 3, so that the PWM unit 3 can adjust the frequency of the working cycle signal according to the reference frequency signal, thereby adjusting the frequency of the pulse power. The resonance unit 4 has a resonant property, so that the frequency of the pulse power can influence the resonance unit 4 to convert the voltage gain of the driving power. When the pulse power is under a starting frequency and a working frequency higher than the starting frequency, the resonance unit 4 may form a starting voltage gain and a working voltage gain respectively corresponding to the starting frequency and the working frequency, wherein the starting voltage gain is larger than the working voltage gain, so that it can provide higher voltage to initiate the lamp tube set 9. The circuit for achieving this property is shown as the resonance unit 3 in FIG. 3. The resonance unit 4 includes a first resonance inductor ($L_r$) 42, a second resonance inductor ($L_m$) 43 and a resonance capacitor ($C_s$) 41, wherein the first resonance inductor 42 and the resonance capacitor 41 are serially connected with the primary side coil of the transformer 5, and the second resonance inductor 43 is connected to the two ends of the primary side coil, so that the first resonance inductor 42 and the second resonance inductor 43 are connected in parallel as view from the primary side coil. The transfer function of the resonance unit 4 described above is as followed:

$$A = \frac{L_r}{L_m} \tag{2-1}$$

which is the specific value of the first resonance inductor ($L_r$) 42 and the second resonance inductor ($L_m$) 43, wherein $$L = L_r + L_m \tag{2-2}$$

which is the serial equivalent inductors of the resonance unit 4, $$\omega_o = \frac{1}{\sqrt{LC_s}} \tag{2-3}$$

which is the resonance frequency, $$Z_o = \omega_o L = \frac{1}{\omega_0 C_s} = \sqrt{\frac{L}{C_s}} \tag{2-4}$$

which is the property impedance of the resonance unit 4, and $$Q = \omega_o C_s R_{lamp} = \frac{R_{lamp}}{\omega_o L} = \frac{R_{lamp}}{Z_o} \tag{2-5}$$

which is the serial resonance quality factor. Therefore, the transfer function of the resonance unit 4 is $$\frac{v_1(j\omega)}{v_d(j\omega)} = \frac{1}{(1+A)\left[1-\left(\frac{\omega_o}{\omega}\right)^2\right] + j\frac{1}{Q}\left(\frac{\omega}{\omega_o}\frac{A}{1+A} - \frac{\omega_o}{\omega}\right)} \tag{2-6}$$

And, the gain of formula 2-6 is $$\left|\frac{v_1(j\omega)}{v_d(j\omega)}\right| = \frac{1}{\sqrt{(1+A)^2\left[1-\left(\frac{\omega_o}{\omega}\right)^2\right]^2 + \frac{1}{Q^2}\left(\frac{\omega}{\omega_o}\frac{A}{1+A} - \frac{\omega_o}{\omega}\right)^2}} \tag{2-7}$$

Figures 4, 5:
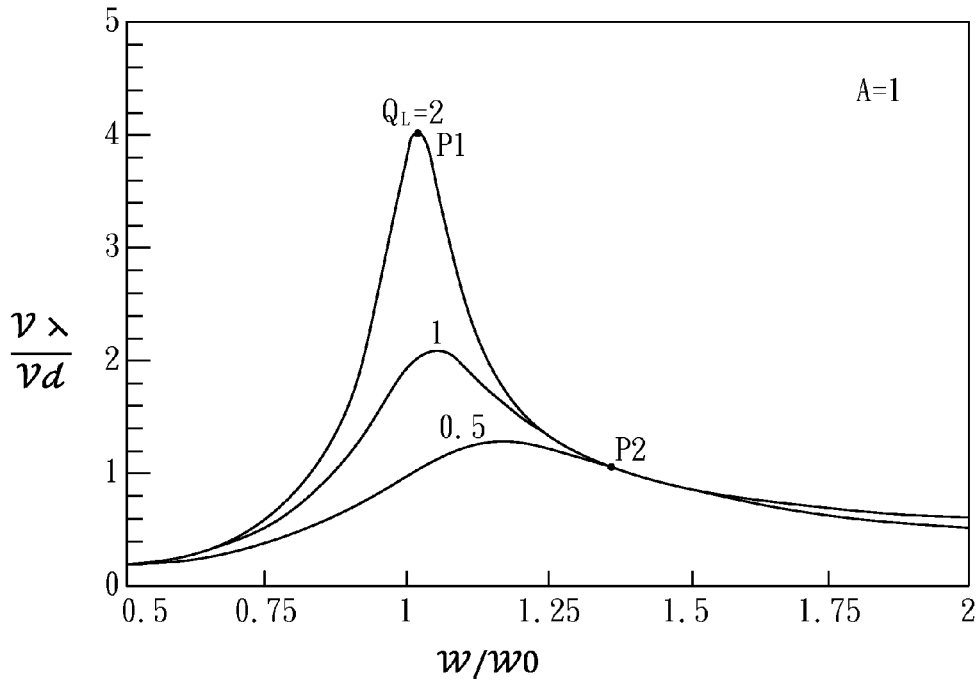
FIG. 4 shows a gain curve of transfer function of FIG. 3.
FIG. 5 shows the test result of the circuit shown in FIG. 3.

When the inverter wants to initiate the lamp tube set 9, the lamp tube set 9 has a higher equivalent resistor ($R_{lamp}$) since it is identical to an open circuit, and since the inverter does not start to work, there is no current passing through the resonance unit 4, and thus, at this time, the PWM unit 3 can produce a working cycle signal at the preset starting frequency, such that the resonance unit 4 can be initiated at the starting frequency, so as to produce the starting voltage gain corresponding to the starting frequency. Therefore, the resonance unit 4 can have a higher voltage gain for smoothly initiating the lamp tube set 9. Then, after the lamp tube set 9 is initiated, the current passes through the secondary side of the transformer 5, so that the feedback unit 7 can obtain the feedback signal for transmitting to the PWM unit 3, so as to force the PWM unit 3 to work at the preset working frequency, and then, the resonance unit 4 can produce a working voltage gain corresponding to the working frequency of the pulse power. As shown in FIG. 4, when the lamp tube set 9 is initiated, the resonance unit 4 works at the starting voltage gain P1, and after the lamp tube set 9 works normally, the resonance unit 4 works at the working voltage gain P2 with higher frequency. Therefore, the resonance unit 4 can provide different voltage gains as the lamp tube set 9 is initiated and is normally working, so as to facilitate the initiation of the lamp tube set 9, and after the lamp tube set 9 works normally, the resonance unit 4 can provide the corresponding voltage gain in accordance with the frequency of the pulse power, thereby achieving the brightness control of the lamp tube set 9. FIG. 5 shows the test result of the circuit described above, which controls the output power through adjusting the resonance unit 4, wherein Pin represents the power inputted to the inverter, and Fs represents the working frequency of the resonance unit 4. As shown in Table in FIG. 5, from row 1 to row 6, when the resonance unit 4 has a lower working frequency, a higher lamp tube voltage ($V_{lamp}$) can be produced which facilitates the initiation of the lamp tube set 9, and after the lamp tube set 9 works normally, the equivalent resistor ($R_{lamp}$) thereof reduces and the frequency rises to a higher working frequency, and further, owing to the frequency variation, the voltage gain of the resonance unit 4 reduces so as to lower down the lamp tube voltage ($V_{lamp}$). According to the test result shown in FIG. 5, it confirms that the circuit architecture of the first resonance inductor 42, the second resonance inductor 43 and the resonance capacitor 41 used in the resonance unit 4 can alter the voltage of the output power through controlling the working frequency, thereby achieving a brightness adjustment of the lamp tube set 9.

In addition, the inductances of the first resonance inductor 42 and the second resonance inductor 43 are different, and the ratio thereof should be lower than 10:1, so as to ensure that the resonance unit 4 possesses the resonant property described above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inverter with adjustable resonance gain, comprising:

a PWM (Pulse Width Modulation) unit, a switch unit, a resonance unit, a transformer, a feedback unit, a dimming signal source, and a frequency control unit, wherein the inverter is connected to a power source for obtaining a DC power, the PWM unit produces a working cycle signal to drive the switch unit to convert the DC power into a pulse power, and the resonance unit converts the pulse power into a driving power, which is provided to the transformer for being converted into an output power, so as to drive a lamp tube set linked to the inverter, and wherein the dimming signal source produces a dimming signal, the feedback unit obtains a feedback signal from the secondary side of the transformer, and the frequency control unit, in accordance with the dimming signal and the feedback signal, decides a reference frequency signal for providing to the PWM unit to adjust the frequency of the working cycle signal, when the pulse power is under a starting frequency and a working frequency higher than the starting frequency, the resonance unit produces a starting voltage gain and a working voltage gain respectively corresponding to the starting frequency and the working frequency, wherein the starting voltage gain which is used to initiate the lamp tube set is larger than the working voltage gain.

2. The inverter with adjustable resonance gain as claimed in claim 1, wherein the resonance unit comprises a first resonance inductor, a second resonance inductor and a resonance capacitor, wherein the first resonance inductor and the resonance capacitor are serially connected with the primary side coil of the transformer, and the second resonance inductor is connected to the two ends of the primary side coil, so that the first resonance inductor and the second resonance inductor are connected in parallel as view from the primary side coil.

3. The inverter with adjustable resonance gain as claimed in claim 2, wherein the inductances of the first resonance inductor and the second resonance inductor are different.

4. The inverter with adjustable resonance gain as claimed in claim 2, wherein the ratio of the two inductors of the resonance unit is lower than 10:1.

* * * * *